United States Patent [19]

Sniezak

[11] Patent Number: 4,586,282

[45] Date of Patent: May 6, 1986

[54] GRIP ASSEMBLY FOR A HANDGUN

[75] Inventor: Gary Sniezak, Agawam, Mass.

[73] Assignee: Bangor Punta Corporation, Springfield, Mass.

[21] Appl. No.: 688,731

[22] Filed: Jan. 4, 1985

Related U.S. Application Data

[63] Continuation of Ser. No. 538,231, Oct. 3, 1983, abandoned.

[51] Int. Cl.[4] ..... F41C 23/00

[52] U.S. Cl. ..... 42/71 P

[58] Field of Search ..... 42/7, 71 R, 71 P

[56] References Cited

U.S. PATENT DOCUMENTS

| | | | |
|---|---|---|---|
| 1,410,266 | 3/1922 | Pedersen | 42/7 |
| 1,531,796 | 3/1925 | Loomis | 42/71 P |
| 3,397,475 | 8/1968 | Mikus | 42/71 P |
| 4,043,066 | 8/1977 | Pachmayr et al. | 42/71 P |
| 4,221,066 | 9/1980 | Hillberg | 42/71 P |

*Primary Examiner*—Charles T. Jordan

*Assistant Examiner*—Ted L. Parr

*Attorney, Agent, or Firm*—Patrick J. Walsh

[57] ABSTRACT

Disclosed is a grip assembly having a pair of side grips and a heel grip. Each side grip has a plurality of inwardly directed projections arranged to conform to the outline of an opening in the frame. Forwardmost projections of the side grips are undercut to lock the forward edges of the side grips to the frame in final assembly. The remaining projections bear against the margin of the frame opening to prevent shifting movement of the side grips in a plane parallel to the plane containing the handgun. The side grips also carry undercut inwardly directed projections adjacent their rear edges. The heel grip includes a leaf spring, the opposite lateral ends of which engage the undercut rear projections of the side grips in final assembly to lock the rear edges of the side grips against movement laterally outwardly of said frame. The heel grip is secured to the frame by a pin inserted through the frame and heel grip adjacent the lower end of the heel grip.

15 Claims, 8 Drawing Figures

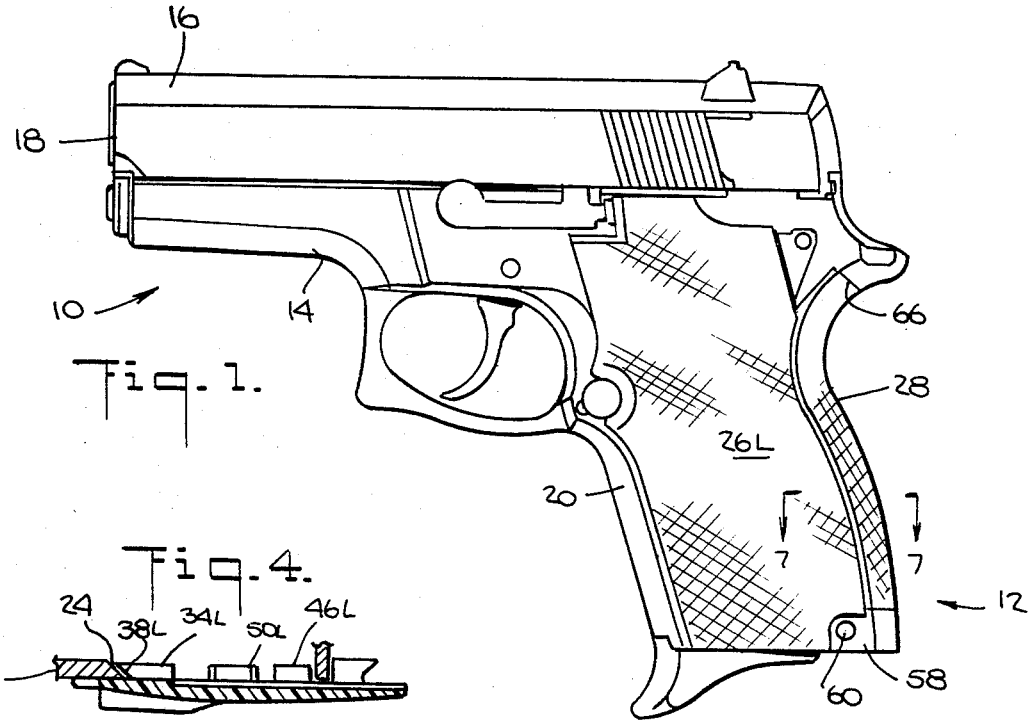
Fig. 1.
Fig. 4.
Fig. 2.
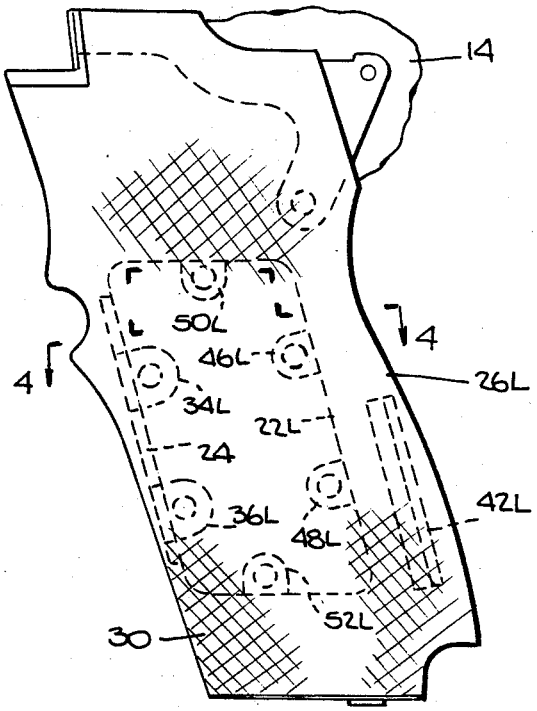
Fig. 3.
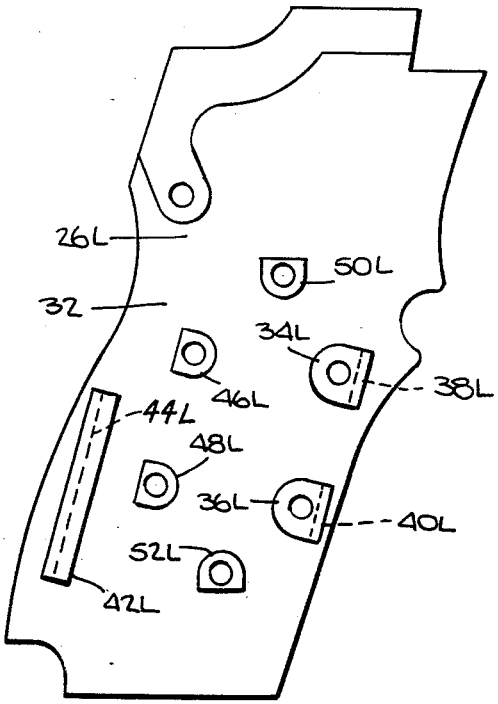

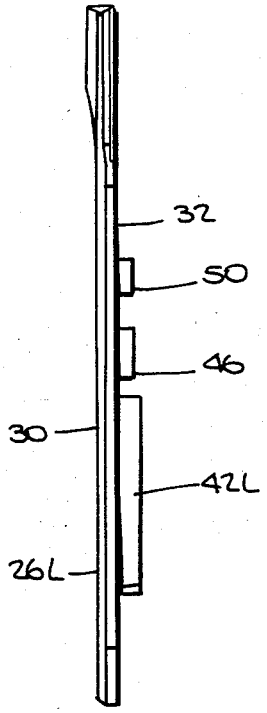
Fig. 5.
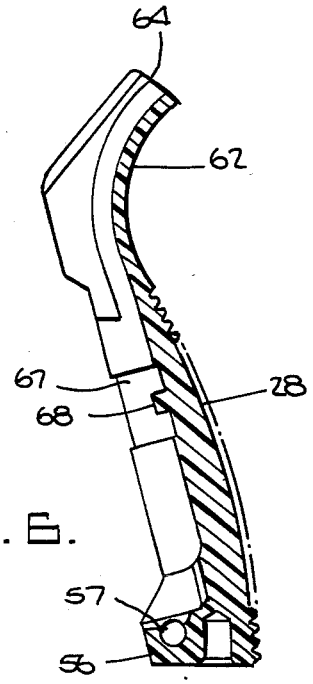
Fig. 6.
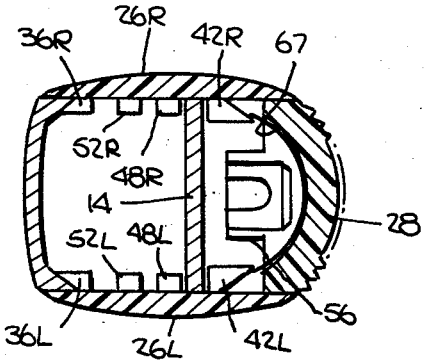
Fig. 7.
Fig. 8.
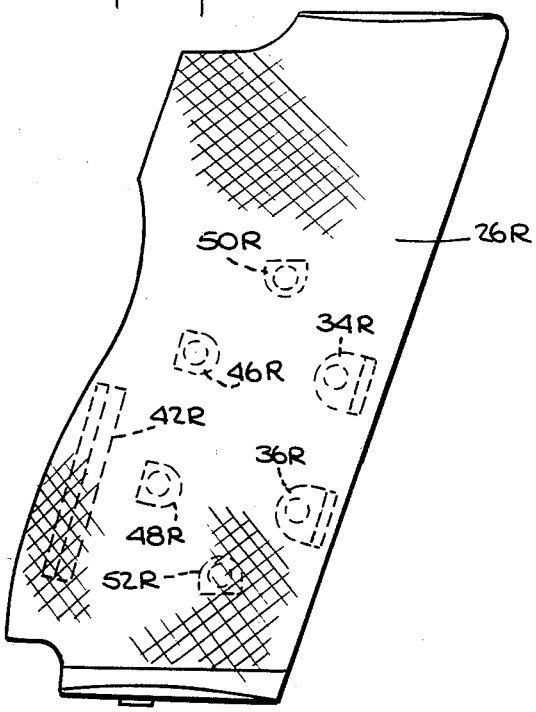

GRIP ASSEMBLY FOR A HANDGUN

This is a continuation Ser. No. 538,231 filed Oct. 3, 1983 now abandoned.

BACKGROUND OF THE INVENTION

The present invention relates to a grip assembly for a handgun and particularly relates to an assemblage of side grips and a heel grip on the handle of a handgun of the automatic type.

It is highly desirable in using a handgun, particularly an automatic, to have a thin handle so that the handgun can be readily and comfortably accommodated in the hand of the individual shooter. However, a substantial portion of the width of the handle of a handgun is attributable to locating the magazine in the handle of the gun as well as other mechanisms necessary to the operation of the handgun. Consequently, it is highly desirable to provide grips for the handle of the handgun which are very thin and do not substantially increase the width or thickness of the handle or the overall bulk of the handgun. This necessitates very careful design of the handgun grips with a view particularly to avoid connections between the grips and handgun frame involving bulky screws, studs and the like which would ordinarily increase the thickness and bulk of the handle. Also, in certain instances, it is desirable to interchange different grips on the same handgun. Optimum grip design must therefore accommodate the need for a compact comfortable feeling handle as well as the need to facilitate interchange of grips on the handgun.

SUMMARY OF THE PRESENT INVENTION

It is a primary object of the present invention to provide a novel and improved grip assembly for a handgun wherein particularly thin side grips are utilized thereby providing a thin compact handle.

It is another object of the present invention to provide a novel and improved grip assembly for a handgun wherein the side grips and the frame of the handgun cooperate with one another to automatically lock the side grips against movement in the plane of the handgun.

It is a further object of the present invention to provide a novel and improved grip assembly for a handgun wherein a heel grip locks the side grips to and prevents their removal from the frame of the handgun.

It is a further object of the present invention to provide a novel and improved grip assembly for a handgun wherein bulky screws, studs and the like to connect the grips to the frame are avoided thereby providing a compact, thin and comfortable grip.

It is a still further object of the present invention to provide a novel and improved grip assembly for a handgun wherein the side grips and heel grip can be readily and easily removed and reattached or interchanged with other grips and without the need for special tools.

Additional objects and advantages of the invention will be set forth in part in the description which follows and in part will be obvious from the description, or may be learned by practice of the invention. The objects and advantages of the invention may be realized and attained by means of the instrumentalities and combinations particularly pointed out in the appended claims.

To achieve the foregoing and other objects and advantages and in accordance with the purposes of the present invention, as embodied and broadly described herein, a grip assembly for the handle of the handgun constructed in accordance with the present invention comprises; a pair of generally flat grips for respectively overlying the opposite sides of the handle, each of the grips having at least one inwardly directed projection disposed adjacent its forward edge for reception within the corresponding opening in the side of the handgun frame and engagement against the forward edge of such corresponding opening in final assembly of the grips on the handgun, the projection being undercut along its forward edge to engage the corresponding edge of the frame to preclude movement of the forward edge portion of the grip laterally outwardly of the frame, each of the grips having an inwardly directed projection disposed adjacent its rear edge, each rear projection having an undercut along its rear edge, a heel grip for overlying the rear edge of the handle of the frame, means carried by the heel grip along opposite sides thereof for respectively engaging the rear projections of the side grips along the undercut rear edges thereof to preclude movement of the rear edge portions of the side grips laterally outwardly of the frame in final assembly of the side grips and heel grip with the frame, and means carried by the heel grip for securing the heel grip and the frame one to the other.

The accompanying drawings which are incorporated in and constitute a part of this specification, illustrate one embodiment of the invention and, together with the description, serve to explain the principles of the invention.

DESCRIPTION OF THE DRAWINGS

FIG. 1 is a side elevational view of a handgun illustrating a grip assembly constructed in accordance with the present invention and in final assembly on the handle of the handgun;

FIG. 2 is a fragmentary enlarged side elevational view of the handle portion of the handgun illustrated in FIG. 1 and illustrating the left side grip assembly hereof secured to the frame of the handgun;

FIG. 3 is a side elevational view of the left side grip looking at the inside face of the grip; i.e., the side grip of FIG. 2 reversed in position;

FIG. 4 is a cross sectional view of the grip of FIG. 2 taken generally about on line 4—4 in FIG. 2;

FIG. 5 is an end elevational view of the left side grip illustrated in FIG. 2 looking from right to left in FIG. 2;

FIG. 6 is a vertical cross sectional centerline view of the heel grip of the grip assembly;

FIG. 7 is a fragmentary cross sectional view of the heel grip, frame and side grips illustrating the connection therebetween and taken generally about on line 7—7 in FIG. 1; and FIG. 8 is a side elevational view of the right side grip of the grip assembly hereof.

DESCRIPTION OF A PREFERRED EMBODIMENT

Reference will now be made in detail to the preferred embodiment of the present invention, an example of which is illustrated in the accompanying drawings.

Referring now to the drawings, particularly to FIG. 1, there is illustrated a handgun of the automatic type, generally designed 10, having a grip assembly constructed in accordance with the present invention and generally designed 12. Handgun 10 includes a frame 14, a slide 16 about barrel 18, and a handle 20 including grip assembly 12. Further description of the handgun 10 is not believed necessary as the relevant features of the present invention relate to grip assembly 12 and its connection with the handle portion of frame 14. Referring to FIG. 2, each of the side portions of the handle of frame 14 has an opening 22 in the form of a parallelogram, the opening 22L on the left side of the handgun being illustrated by the dashed lines in FIG. 2. As illustrated in FIG. 4, the forward edge 24 of each opening 22 has an inwardly and forwardly directed bevel for reasons discussed hereinafter.

Grip assembly 12 includes left and right hand side grips 26L and 26R, respectively and a heel grip 28. The left and right hand side grips, insofar as their connection to frame 14 and with heel grip 28 are concerned, are identical mirror images one to the other except for their disposition on opposite sides of the handgun and certain features not forming a part of this invention. It is therefore believed that a description of one side grip using reference numerals followed by the suffix L to denote the left side grip will suffice for a description of the other side grip with the identical reference numerals applied followed by the suffix R to denote the right side grip. For convenience of description in certain instances, only references numerals will be used in describing the grips, it being understood that the suffixes L or R are applied to the drawings. Side grip 26L comprises a generally thin flat piece with a roughened outer surface 30 to provide a feel for the grip and a smooth inner surface 32 from which various projections, to be described, extend inwardly toward frame to position and lock the grip to the frame. The peripheral outline of each side grip illustrated in FIGS. 2 and 8 generally follows the outline of the handle taking into account various mechanisms such as the slide stop assembly and others. The side grips thus overlie the respective opposite sides of the handle and their manner of securement to the handgun will now be described.

Each grip has at least one inwardly directed projection disposed adjacent its forward edge for reception in the corresponding opening 22 in the side of the handgun frame and engagement against the forward edge of the corresponding opening. In a preferred embodiment hereof, two vertically spaced projections 34 and 36 are provided on each side grip 26, the projections 34L and 36L being illustrated in FIGS. 2 and 3. Projections 34L and 36L have undercuts 38L and 40L along their forward edges respectively, engaging the bevelled edge 24 of frame 14. Each grip has an elongated inwardly directed projection 42 disposed adjacent its rear edge. Projections 42 are undercut along their rear edges at 44, for cooperation with a heel grip spring in a manner described hereinafter.

At least one intermediate projection is also provided each grip between the forward and rear projections 34, 36, and 42, respectively. Preferably, a pair of vertically spaced inwardly directed projections 46 and 48 are provided each grip. Projections 46 and 48 have flat rearwardly facing edges. Also, a pair of vertically spaced inwardly directional projections 50 and 52 are provided. Projection 50 has a flat edge facing upwardly while projection 52 has a flat edge facing downwardly. From a review of FIG. 2, it will be appreciated that the upper and lower projections 50 and 52 and the intermediate projections 46 and 48 are located such that the flat edges engage against the corresponding edges of the opening 22 in frame 14. That is, when applying each side grip to the handle the undercuts of projections 34 and 36 are first inserted into opening 22 to underlie the bevelled edge 24. The remaining projections 46, 48, 50, and 52 are then in position to be received in opening 22. In this manner, each grip is accurately located vis-a-vis the handle and prevented from shifting in the plane of the handgun.

Heel grip 28 comprises a unitary elongated, preferably plastic, piece shaped to provide a comfortable grip for the palm of the shooter's hand. Grip 28 is generally arcuate in cross section, as best illustrated in FIG. 7, and has a stepped lower end or boss 56 for reception between a pair of laterally spaced legs 58 which project rearwardly from the lower end of the handle. End 56 has a laterally opening aperture 57 which, in final assembly, is alined with openings through legs 58. A pin 60 (FIG. 1) is receivable through the alined openings and aperture to secure the heel grip to the frame 14. The opposite end of heel grip 28 has a rearwardly curved section 62 which terminates in a flat 64. In final assembly flat 64 engages below a corresponding flat 66 (FIG. 1) formed on the frame 14.

In accordance with the present invention, an arcuate leaf spring 67 extends laterally along the inside face of heel grip 28. A dimple 68 carried by the heel grip extends through a central opening in the leaf spring to secure the latter to the heel grip. The outer ends of leaf spring 67 are spaced from the body of the heel grip as illustrated in FIG. 7 for reasons which will now be discussed in describing the assembly of the grips on the handgun.

To assemble the grips, the side grips 26 are disposed in overlying relation to the respective sides of the handle of the frame. Particularly, the side grips are positioned to aline the projections 34, 36, 46, 48, 50, and 52 with the corresponding opening 22 in the frame. The grips are then displaced forwardly to engage the undercuts 38 and 40 inwardly of the bevelled edges 24 of the frame. With projections 34 and 36 engaging the frame, the remaining projections 46, 48, 50, and 52 may be inserted into the openings 22 thus accurately positioning the side grips against movement in a plane parallel to the plane containing the handgun.

With the side grips thus positioned, heel grip 28 is first located such that the upper end flat 64 butts beneath the flat 66 of the frame. The lower end of heel grip 28 is then swung toward the handle to locate the stepped end 56 between legs 58. Pin 60 is then inserted through the alined aperture 57 and openings in the legs to secure the heel grip to the frame. The upper end of the heel grip is thus also captured and retained against outward movement by the engagement of the flats 64 and 66 against one another.

With the heel grip thus secured to the frame, it will be appreciated that the heel grip 28 also retains the rear edges of the side grips against movement laterally outwardly of the frame. Particularly, the outer ends of leaf springs 67 respectively engage behind the undercuts of rear projections 42. By this engagement with the spring ends, the rear edges of the side grips are retained on the frame against lateral outward movement. It will be recalled that the cooperation of undercuts 38 and 40 on forward projections 34 and 36 and the bevelled frame edge 24 lock the forward edges of the side grips against laterally outward movement relative to the frame. Also, the remaining projections prevent shifting of the side grips parallel to the plane containing the handgun.

Thus, there has been provided a unique grip assembly which is easily and readily secured to the handgun frame, provides a thin compact handle of reduced bulk, and, by the unique cooperation of the foregoing described projections and heel grip spring, eliminates the need for conventional screws and other like fastening devices.

I claim:

1. In a handgun having a frame with a hollow handle and an opening through each of the opposite sides of the handle, a grip assembly for the handle of the handgun comprising:

a pair of generally flat grips for respectively overlying the opposite sides of the handle, each of said grips having at least one inwardly directed projection disposed adjacent its forward edge for reception within the corresponding opening in the side of the handgun frame and engagement against the forward edge of such corresponding opening in final assembly of the grips on the handgun, said projection being undercut along its forward edge to engage the corresponding edge of the frame to preclude movement of the forward edge portion of the grip laterally outwardly of the frame, each of said grips having an inwardly directed projection disposed adjacent its rear edge, each said rear projection having an undercut along its rear edge, a heel grip for overlying the rear edge of the handle of said frame, means carried by said heel grip along opposite sides thereof for respectively engaging the rear projections of said side grips along the undercut rear edges thereof to preclude movement of the rear edge portions of the side grips laterally outwardly of the frame in final assembly of said side grips and heel grip with said frame, and means carried by said heel grip for securing said heel grip and the frame one to the other.

2. A grip assembly according to claim 1 wherein said engaging means includes a spring carried by said heel grip engaging the undercut of said rear projection thereby precluding lateral outward movement of the rear edge portions of said side grips away from the frame.

3. A grip assembly according to claim 2 wherein said spring comprises a generally arcuate leaf spring having free ends adjacent the opposite side edges of said heel grip for engaging the undercuts of said rear projections.

4. A grip assembly according to claim 3 wherein said securing means includes a boss having a laterally extending aperture therethrough at the lower end of said heel grip for reception in a slot formed on the frame having alined laterally extending openings, and a pin for reception in said aperture and the openings when said aperture and openings register one with the other in final assembly.

5. A grip assembly according to claim 1 wherein each of said side grips has at least one inwardly directed projection disposed intermediate its forward and rear edges for reception in the corresponding openings in the side of the handgun frame and engagement against the edge of such corresponding opening in final assembly thereby, in cooperation with the forward projection on such side grip, preventing movement of said side grip in either forward or rearward directions relative to the frame.

6. A grip assembly according to claim 5 wherein said engaging means includes a spring carried by said heel grip engaging the undercut of each said rear projection thereby precluding lateral outward movement of the rear edge portion of said side grips away from the frame.

7. A grip assembly according to claim 6 wherein said spring comprises a generally arcuate leaf spring having free ends adjacent the opposite side edges of said heel grip for engaging the undercuts of said rear projections.

8. A grip assembly according to claim 1 wherein each of said side grips has a pair of vertically spaced projections for reception within the corresponding opening in the side of the handgun frame and engagement against the respective upper and lower edges of such corresponding opening in final assembly of the grips on the handgun.

9. A grip assembly according to claim 8 wherein each of said side grips has at least one inwardly directed projection disposed intermediate its forward and rear edges for reception in the corresponding opening in the side of the handgun frame and engagement against the rear edge of such corresponding opening in final assembly of the side grips on the handgun thereby, in cooperation with the forward projection on said side grip, preventing movement of said side grip in either forward or rearward directions relative to the frame.

10. A grip assembly according to claim 9 wherein said engaging means includes a spring carried by said heel grip engaging the undercut of each said rear projection thereby precluding lateral outward movement of the rear edge portions of said side grips away from the frame.

11. A grip assembly according to claim 10 wherein said spring comprises a generally arcuate leaf spring having free ends adjacent the opposite side edges of said heel grip for engaging the undercut of said rear projections.

12. A grip assembly according to claim 9 wherein each of said grips has a pair of inwardly directed projections spaced generally vertically one from the other and disposed adjacent its forward edge for reception within the corresponding opening in the side of the handgun frame and engagement against the forward edge of such corresponding opening in final assembly of the grips on the handgun, each of said forward projections being undercut along its forward edge to engage the corresponding edge of the frame to preclude movement of the forward edge portion of the side grip laterally outwardly of the frame in final assembly, each of said side grips having a pair of vertically spaced inwardly directed projections disposed intermediate its forward and rear edges for reception in the corresponding opening in the side of the handgun frame and engagement against the rear edge of such corresponding opening in final assembly of the side grips on the handgun thereby, in cooperation with the pair of forward projections of said side grip, preventing movement of said side grip in either forward or rearward directions relative to the frame.

13. A grip assembly according to claim 12 wherein said engaging means includes a spring carried by said heel grip engaging the undercut of each said rear projections thereby precluding lateral outward movement of the rear edge portions of said side grips away from the frame.

14. A grip assembly according to claim 13 wherein said spring comprises a generally arcuate leaf spring having free ends adjacent the opposite side edges of said heel grip for engaging the undercuts of said rear projections.

15. A grip assembly according to claim 14 wherein said securing means includes a boss having a laterally extending aperture therethrough at the lower end of said heel grip for reception in a slot formed on the frame having alined laterally extending openings, and a pin for reception in said aperture and the openings when said aperture and openings register one with the other in final assembly.

* * * * *